US007305844B2

(12) United States Patent
Cho et al.

(10) Patent No.: US 7,305,844 B2
(45) Date of Patent: Dec. 11, 2007

(54) COMBINED TYPE AIR CONDITIONER

(75) Inventors: Jin Myeong Cho, Gimhae-Si (KR); Moon Shin Kim, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 192 days.

(21) Appl. No.: 11/191,066

(22) Filed: Jul. 28, 2005

(65) Prior Publication Data

US 2006/0021370 A1 Feb. 2, 2006

(30) Foreign Application Priority Data

Jul. 30, 2004 (KR) ..... 10-2004-0060173
Jul. 30, 2004 (KR) ..... 10-2004-0060174

(51) Int. Cl.
*F25D 23/12* (2006.01)

(52) U.S. Cl. ..... 62/262; 62/263

(58) Field of Classification Search ..... 62/150, 62/259.1, 262, 291, 186, 298, 263, 419; 165/121, 165/122; 454/201, 236
See application file for complete search history.

(56) References Cited

U.S. PATENT DOCUMENTS 3,748,997 A * 7/1973 Dean et al. ..... 454/234
3,932,157 A * 1/1976 Bolton et al. ..... 62/408
3,938,348 A * 2/1976 Rickert ..... 62/97
4,100,764 A * 7/1978 Murano ..... 62/289
4,109,482 A * 8/1978 Pearson ..... 62/180
4,747,275 A * 5/1988 Amr et al. ..... 62/419
5,038,577 A * 8/1991 Stanford ..... 62/262
6,196,013 B1 * 3/2001 Kim ..... 62/262
6,701,738 B2 * 3/2004 Kobayashi et al. ..... 62/262
6,745,589 B2 * 6/2004 Katatani et al. ..... 62/259.1
7,021,076 B2 * 4/2006 Park et al. ..... 62/262
7,032,404 B2 * 4/2006 Kim et al. ..... 62/262
2003/0029184 A1 * 2/2003 Ohama et al. ..... 62/262

FOREIGN PATENT DOCUMENTS

CN 1362599 A 8/2002
JP 11-287473 A * 10/1999

* cited by examiner

*Primary Examiner*—Mohammad M. Ali
(74) *Attorney, Agent, or Firm*—Birch, Stewart, Kolasch & Birch, LLP

(57) ABSTRACT

A combined type air conditioner is disclosed, by which manufacturing or assembly of the air conditioner is facilitated. The present invention includes a cabinet forming an exterior of the air conditioner to suck and blow an air by driving a blowing fan and an air guide provided within the cabinet to accommodate the blowing fan, the air guide guiding the air introduced into the cabinet to an air blowing port provided to the cabinet. And, the air guide includes a lower guide provided to a bottom of the cabinet and an upper guide assembled to an upper part of the lower guide to cover an upper side of the blowing fan, the upper guide having a blowing guide guiding an air-conditioned air to the air blowing port.

14 Claims, 10 Drawing Sheets

COMBINED TYPE AIR CONDITIONER

This application claims the benefit of the Korean Patent Application Nos. P2004-60173 and P2004-60174, both filed on Jul. 30, 2004, which are hereby incorporated by reference as if fully set forth herein.

BACKGROUND OF THE INVENTION

1. Field of the Invention

The present invention relates to an air conditioner, and more particularly, to a combined type air conditioner. Although the present invention is suitable for a wide scope of applications, it is particularly suitable for combining an indoor unit and an outdoor unit mutually.

2. Discussion of the Related Art

Generally, an air conditioner, which includes a compressor and a heat exchanger to make a refrigerant flow therein, cools down or heats an indoor space such as a living room, a restaurant, a library, an office and the like. And, air conditioners can be classified into a separate type and a combined type.

The separate type air conditioner consists of an indoor unit having a heat exchanger for cooling or heating an indoor space, an outdoor unit having a built-in heat exchanger for heat exchange with an outdoor air, and a refrigerant pipe connecting the indoor unit and the outdoor unit together.

The indoor and outdoor units of the separate type air conditioner are separately installed at indoor and outdoor spaces, respectively.

Meanwhile, the combined type air conditioner, which includes indoor and outdoor units built in one body together, is directly installed on a hole of a house wall or is hung on a window.

An air conditioner according to a related art is explained with reference to FIGS. 1 to 3 as follows.

The air conditioner according to the related art shown in FIGS. 1 to 3 is the combined type air conditioner having an indoor unit for a heat exchange with an indoor air and an outdoor unit for a heat exchange with an outdoor air, in which the indoor and outdoor units are built in one body.

Referring to FIGS. 1 to 3, the air conditioner consists of a base panel 2 forming a bottom, a frame 4 provided over the base panel 2, an air guide 6 partitioning the base panel 2 and the frame 4 into an indoor part 'I' and an outdoor part 'O', a front panel 9 provided to a front side of the cabinet 4 toward an indoor space to configure a front part of the combined type air conditioner, and a compressor 12 changing a low-temperature low-pressure gaseous refrigerant into a high-temperature high-pressure refrigerant.

In the outdoor part 'O', a condenser 14 radiating heat to air flowing within the outdoor part and an expansion valve (not shown in the drawing) expanding the refrigerant condensed by the condenser 14 are accommodated.

To the indoor part 'I' provided is an evaporator 16 that evaporates the refrigerant expanded in the expansion valve. In doing so, the refrigerant absorbs heat of the air flowing within the indoor part to evaporate into a gaseous phase.

Meanwhile, outdoor intake ports 5 are formed at lateral and upper sides of the outdoor part to suck the outdoor air. A backside of the outdoor part is open to blow the air to the outdoor space.

An indoor air intake port 10 is provided to a lower part of a front side of the front panel 9. And, an indoor air blowing port 11 is provided to an upper part of the front panel 9 to blow the air into the indoor space.

The air guide 6 consists of a vertical guide 7 provided vertical to a topside of the base panel 2, a horizontal guide 8 horizontally provided over the vertical guide 32 approximately to guide the air forcibly moved by an indoor fan 24, which will be explained later, to the indoor air blowing port 11, and a blowing guide 8*a* provided within the horizontal guide 8 to guide the air-conditioned air to the indoor air blowing port 11.

A bi-shaft motor 22 is provided to the air guide 6 of the combined type air conditioner. In this case, front and rear shafts 20*a* and 20*b* are projected from the bi-shaft motor 22 toward the indoor and outdoor parts, respectively.

The indoor fan 24 is connected to the front shaft 20*a* to forcibly circulate the indoor air to the evaporator 16. And, an orifice 26 accelerating a wind speed of air is provided to an intake side of the indoor fan 24.

To fix the orifice 26 to the vertical guide 7 with screws 7*a*, a plurality of first locking holes (not shown in the drawing) are formed at a front side of the vertical guide 7, while a plurality of second holes 26*a* confronting the first locking holes are formed at the orifices 26 to be locked by the screws 7*a*, respectively.

A propeller fan 28 is connected to the rear shaft 20*b* of the bi-shaft motor 20 to forcibly move the outdoor air toward the condenser 14. And, a shroud 30 forming an air passage is provided in rear of the propeller fan 28.

Meanwhile, the vertical guide 7 consists of a fan accommodating portion (not shown in the drawing) to accommodate the indoor fan 24 therein and a partitioning plate 7*a* extending from one side of the fan accommodating portion in a lateral direction to partition the combined type air conditioner into the indoor part 'I' and the outdoor part 'O' together with a backside of the fan accommodating part.

And, a control box 40 for the installation of various electric/electronic parts for controlling the related art combined type air conditioner is loaded in the horizontal guide 8.

In particular, a support panel 8*b* is provided to one side of the horizontal guide 8 to support a bottom of the control box 40 and a plurality of first screw holes 8*c* are formed at one side edge of the horizontal guide 8 to fix the control box 40 with screws 41 and 42.

And, a plurality of second screw holes 40*a* and 40*b* are provided to one side of the control box 40 to confront a plurality of the first screw holes 8*c*, respectively.

An operation of the above-configured related art combined type air conditioner is explained as follows.

First of all, once the combined type air conditioner is actuated, the refrigerant is circulated by the driven compressor 12 via the condenser 14, the expansion mechanism (not shown in the drawing) and the evaporator 16. And, the driven bi-shaft motor 20 rotates the indoor fan 24 and the propeller fan 28 to suck the indoor air and the outdoor air into the indoor part and the outdoor part, respectively.

In particular, the indoor air in front of the front panel 9 passes through the indoor air intake port 10 by the rotation of the indoor fan 24 and is then cooled down via the evaporator 16.

A flowing direction of the air cooled down by the evaporator 16 is diverted along the orifice 26, the vertical guide 7 and the horizontal guide 8 toward the indoor air blowing port 11 provided to the front panel 9 and is then blown to a front side of the front panel 9 via the indoor air blowing port 11.

Meanwhile, the air in the outdoor space is sucked into the outdoor intake ports 5 by the rotation of the propeller fan 28, passes through the shroud 30, passes through the condenser 14 to take heat from the refrigerant flowing within the condenser 14, and is then blown out to the outdoor space.

However, the related art air conditioner has the following problems or disadvantages.

First of all, in the related art air conditioner, since the air guide is configured with many parts including the vertical guide, the horizontal guide, the blowing guide and the like, its configuration is complicated to have difficulty in assembly.

Secondly, in the related art air conditioner, the orifice is assembled using the locking members such as the screws and the like, thereby having difficulty in assembly.

Thirdly, since the interior of the related art air conditioner is partitioned by the vertical guide only, material consumption for manufacturing the vertical guide is increased and the configuration of the vertical guide is complicated.

Fourthly, in the related art air conditioner, the control box, which is fixed to one side of the horizontal guide by a plurality of the screws, needs a number of the screws to have difficulty in assembly. Finally, in the related art air conditioner, since the control box is unstably installed at one side of the horizontal guide, the electric/electronic parts within the control box are short-circuited or malfunction by the vibration generated from the driven air conditioner.

SUMMARY OF THE INVENTION

Accordingly, the present invention is directed to a combined type air conditioner that substantially obviates one or more problems due to limitations and disadvantages of the related art.

An object of the present invention is to provide a combined type air conditioner, by which manufacturing or assembly of the air conditioner is facilitated.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a combined type air conditioner according to the present invention includes a cabinet forming an exterior of the air conditioner to suck and blow an air by driving a blowing fan and an air guide provided within the cabinet to accommodate the blowing fan, the air guide guiding the air introduced into the cabinet to an air blowing port provided to the cabinet. And, the air guide includes a lower guide provided to a bottom of the cabinet and an upper guide assembled to an upper part of the lower guide to cover an upper side of the blowing fan, the upper guide having a blowing guide guiding an air-conditioned air to the air blowing port.

Preferably, an opening is provided to a front side of the air guide. More preferably, openings are provided to front and upper sides of the lower guide, respectively. More preferably, the lower guide includes a drain pan catching a condensed water generated from a heat exchanger and a base portion installed on the bottom of the cabinet.

More preferably, the drain pan configures a front side of the base portion and wherein the heat exchanger is provided over the drain pan.

More preferably, the air guide further includes an orifice provided in front of the blowing fan to cover the opening provided to the front side of the air guide, the air guide having a passage portion perforated in a shaft direction of the blowing fan. More preferably, a lower edge of the orifice is held by the lower guide and an upper edge of the orifice is held by the upper guide assembled to the lower guide. More preferably, the lower guide has at least one lower end holding portion in which a lower end of the orifice is fitted and the upper guide has at least one upper end holding portion in which an upper end of the orifice is fitted.

More preferably, the lower end holding portion includes at least one lower support wall protruding upward from a base portion of the lower guide to support a rear side of the lower edge of the orifice and at least one lower support protrusion spaced apart from the lower support wall in a front direction with a prescribed gap in-between to support a front side of the lower edge of the orifice and the upper end holding portion comprises at least one upper support wall protruding downward from a bottom of the blowing guide to support a rear side of the upper edge of the orifice and at least one upper support protrusion spaced apart from the upper support wall in the front direction with a prescribed gap in-between to support a front side of the upper edge of the orifice.

More preferably, while the orifice is fitted in either the upper or lower guide to be hung, the orifice is fixed to the air guide in a manner that either the lower or upper guide is assembled to either the upper or lower guide to which the orifice is assembled.

Preferably, the combined type air conditioner further includes a control box provided within the cabinet to accommodate various components for controlling the combined type air conditioner, and the control box partitions the cabinet into an indoor part and an outdoor part together with the air guide.

In another aspect of the present invention, a combined type air conditioner includes a cabinet forming an exterior of the air conditioner to suck and blow an air by driving a blowing fan, an air guide guiding the air introduced into the cabinet to an air blowing port provided to the cabinet, and a control box provided within the cabinet to accommodate various components for controlling the combined type air conditioner, the control box partitioning the cabinet into an indoor part and an outdoor part together with the air guide.

Preferably, the control box includes a partition body provided to one side of the air guide to partition the cabinet together with the air guide and a box portion provided to an upper front part of the partition body wherein a control panel displaying operational information is installed at the box portion.

Preferably, the control box includes a support member connected to the lower guide to be supported and a fixing member joined to a bottom of the cabinet to be fixed thereto.

More preferably, a lower end of the support member is inserted in a support recess portion provided to a base portion configuring a bottom of the lower guide. More preferably, the support member is provided to a partition body configuring a backside of the control box and wherein the partition body partitions the cabinet together with the air guide.

More preferably, the fixing member is provided to a partition body configuring a backside of the control box and wherein the partition body partitions the cabinet together with the air guide. More preferably, the fixing member includes a pair of insertion ribs spaced apart from each other in parallel to leave a gap in-between and wherein a locking rib provided to the bottom of the cabinet is inserted between a pair of the insertion ribs to be fixed thereto.

More preferably, a locking hole is provided to each of the locking rib and the insertion ribs to be locked by a locking member.

More preferably, wherein the locking rib is formed by bending a portion of an edge of a base panel configuring the bottom of the cabinet in part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
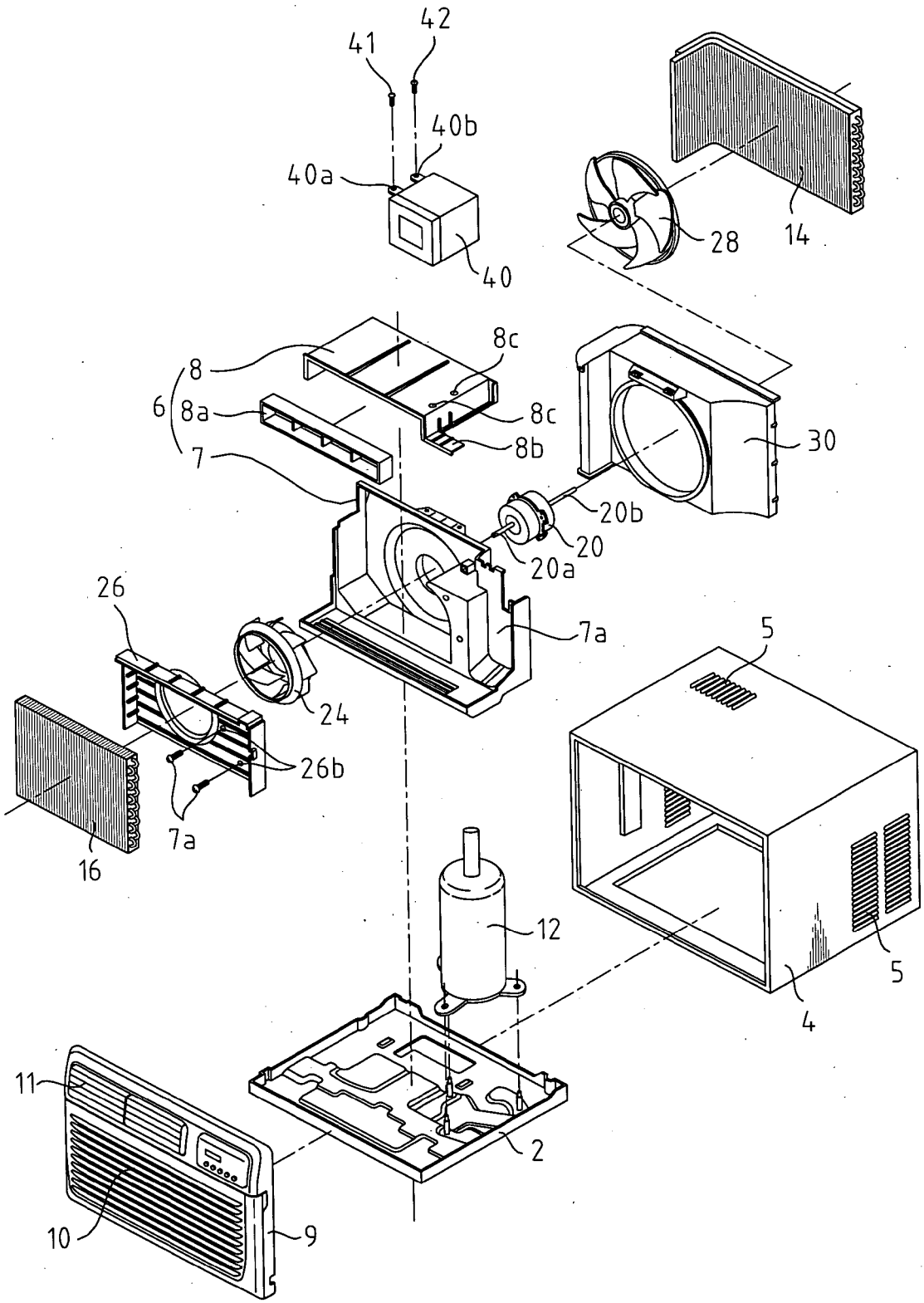
FIG. 1 is an exploded perspective diagram of a combined type air conditioner according to a related art.
Figure 2:
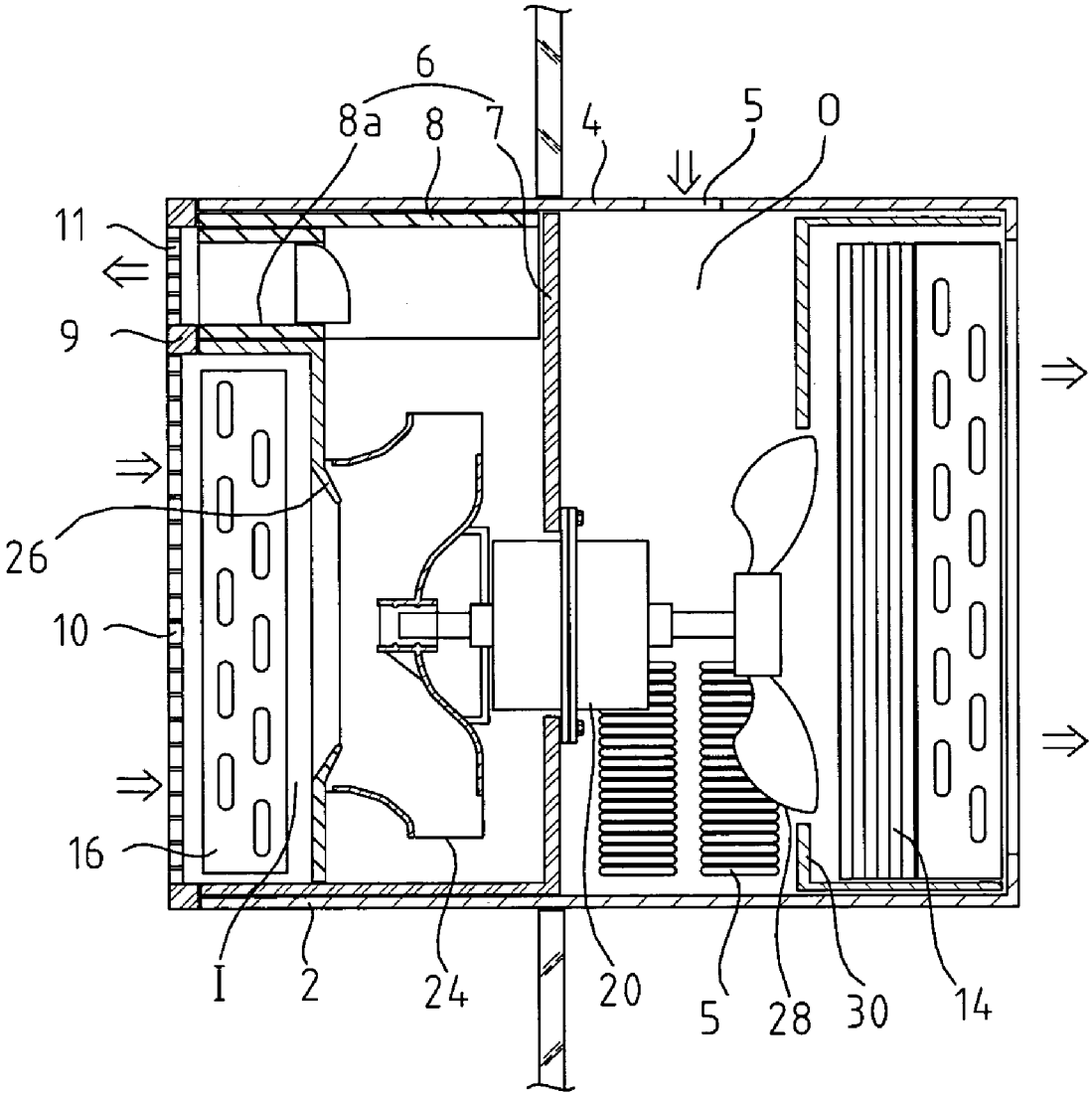
FIG. 2 is a cross-sectional n exploded perspective diagram of a combined type air conditioner according to a related art.
Figure 3:
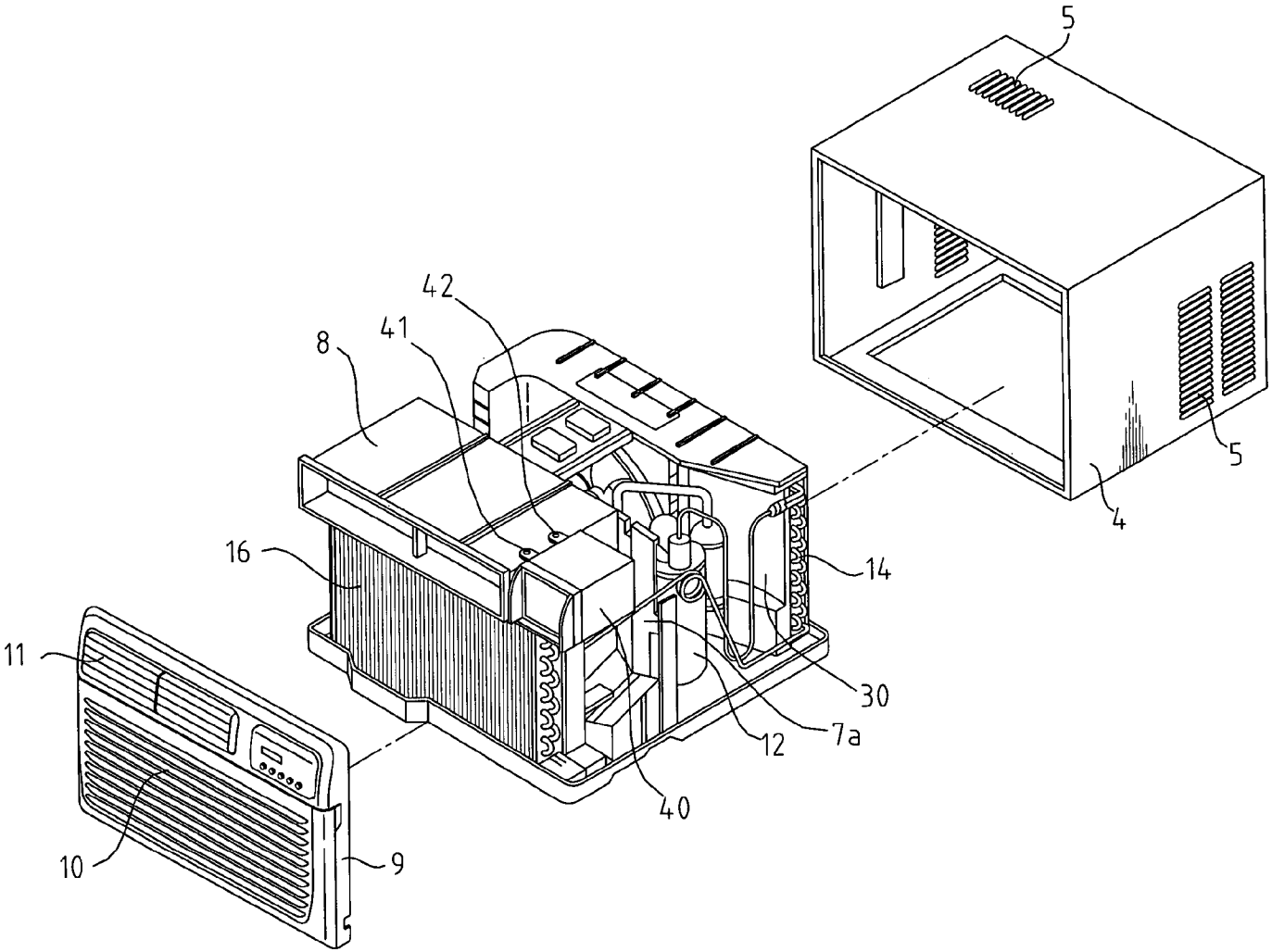
FIG. 3 is an exploded perspective diagram of a combined type air conditioner according to a related art, in which the assembled interior is shown.
Figure 4:
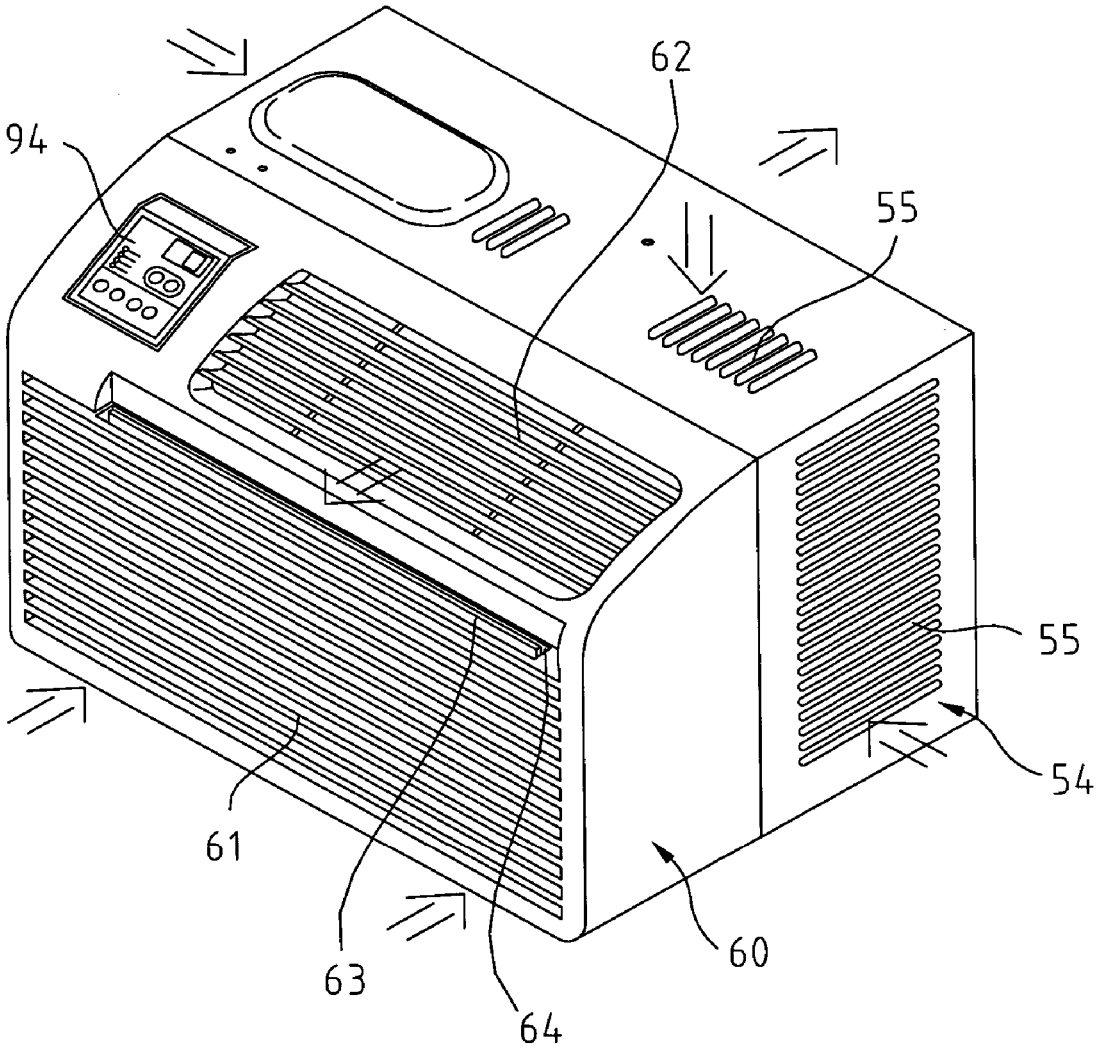
FIG. 4 is a perspective diagram of a combined type air conditioner according to the present invention.
Figure 5:
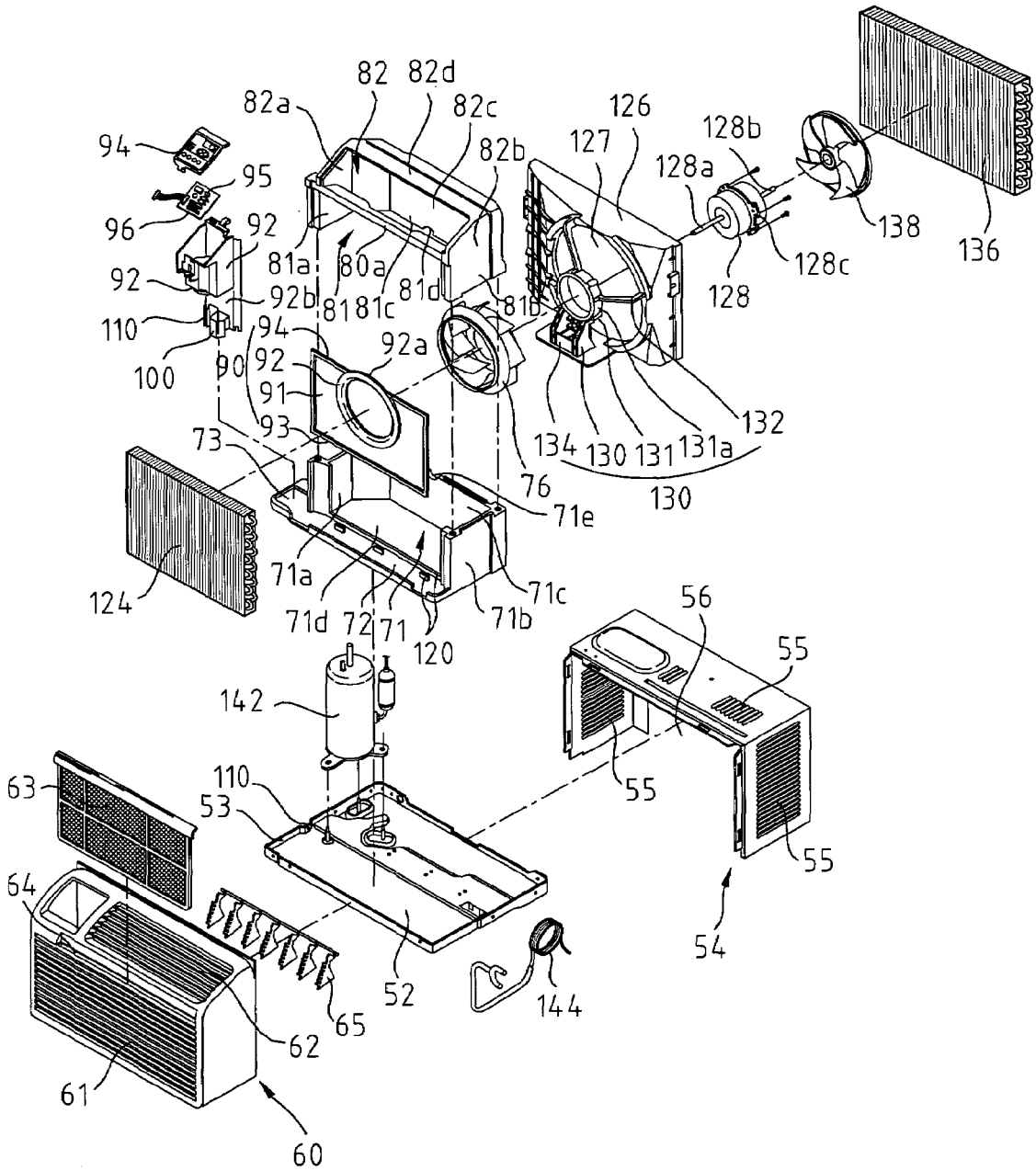
FIG. 5 is an exploded perspective diagram of the combined type air conditioner shown in FIG. 4.
Figure 6:
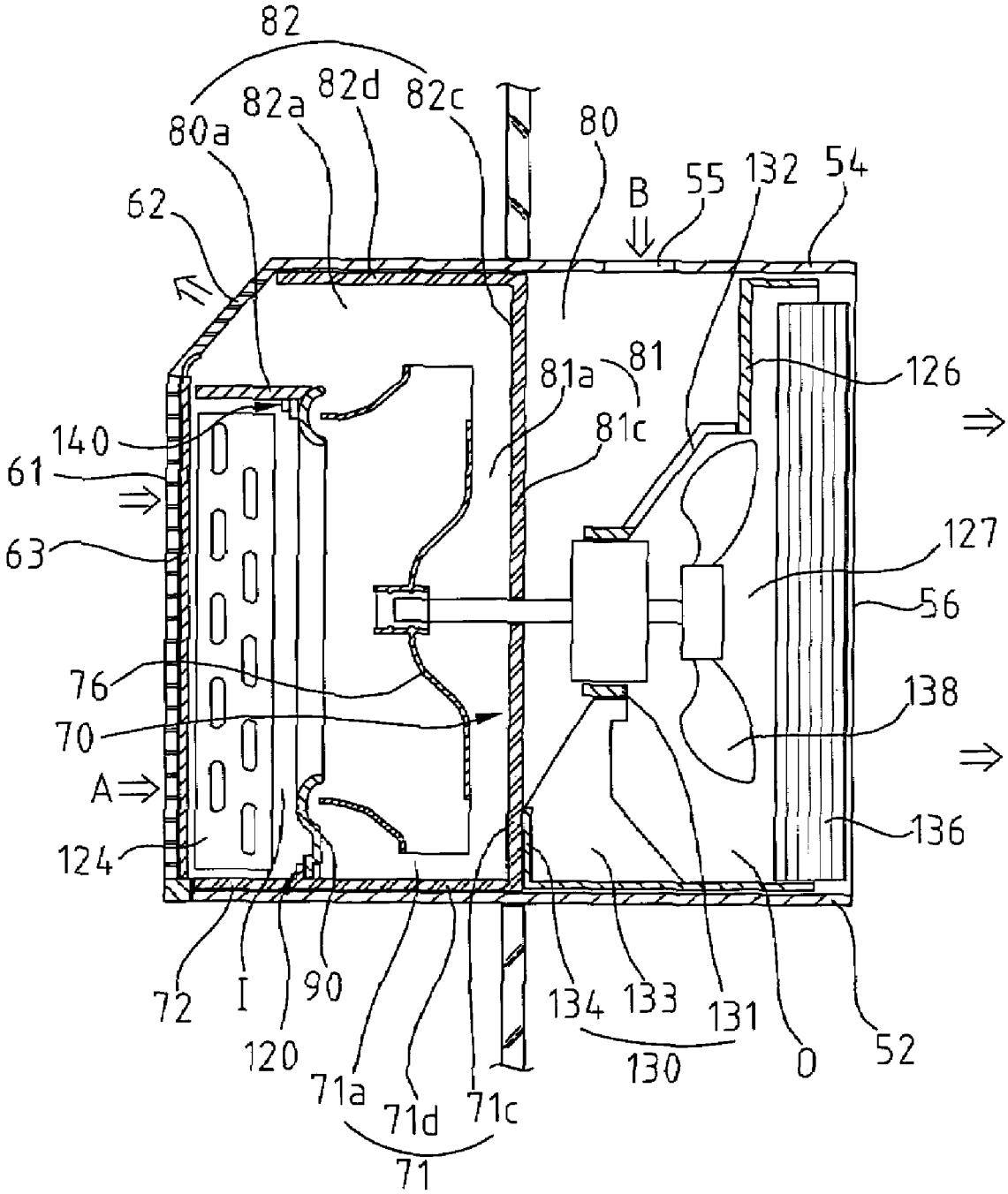
FIG. 6 is a cross-sectional diagram of the combined type air conditioner shown in FIG. 4.

FIG. 4 is a perspective diagram of a combined type air conditioner according to the present invention, FIG. 5 is an exploded perspective diagram of the combined type air conditioner shown in FIG. 4, and FIG. 6 is a cross-sectional diagram of the combined type air conditioner shown in FIG. 4.

Referring to FIGS. 4 to 6, a combined type air conditioner according to the present invention includes a cabinet 52, 54 and 60 configuring its exterior and enclosing various component parts for cooling/heating of an indoor space.

In the embodiment of the present invention, the cabinet preferably includes an indoor part I for heat exchange with an indoor air and an outdoor part O partitioned from the indoor part I for heat exchange with an outdoor air.

In this case, the outdoor part O is provided in rear of the indoor part I so that its outer wall is exposed to an outdoor space.

In this case, the indoor air A is sucked in a front direction of the cabinet and the air-conditioned air in the indoor part I is blown via an upper tilted surface having a predetermined angle with a front side of the cabinet.

And, the outdoor air B is sucked via lateral sides of the cabinet, exchanges heat in the outdoor part O, and is then blown in a rear direction of the cabinet.

Preferably, the cabinet has a fully open backside or has a substantially rectangular box shape having an opening at its backside. Yet, the cabinet can be variously configured.

For instance, the cabinet of the air condition according to one embodiment of the present invention includes a base panel 52 forming a bottom of the cabinet and upper frames 54 and 60 provided over the base panel 52.

In the present embodiment, a flange (not shown in the drawing) is formed on an edge 53 of the base panel to be bent upward. And, the upper frame 54 forms right, left and upper sides of the cabinet.

And, the upper frame 54 includes an indoor frame 60 and an outdoor frame 54 provided in rear of the indoor frame 60. And, an indoor air intake portion 61 having an intake grill for sucking the indoor air is provided to a front side of the indoor frame 60.

For example, the base panel 52, the indoor frame 60 and the outdoor frame 54 can be built in one body. Preferably, the base panel 52, the indoor frame 60 and the outdoor frame 54 are individually provided to be assembled in one body together for the sake of repair or cleaning of internal parts.

The indoor frame 60 blows the air-conditioned air into the indoor space via an indoor air blowing portion 62 provided over the indoor air intake portion 61.

In particular, the indoor air blowing portion 62 is provided to an upper tilted surface provided to an upper front side of the indoor frame 60.

The upper tilted surface is upwardly tilted in a rear direction gradually. Preferably, the indoor air blowing portion 62 preferably includes a blowing grill.

A filter 63 for purifying an air introduced into the indoor part is provided within the indoor frame 60, and more particularly, in rear of the indoor air intake portion 61.

For this, a filter insertion portion 64 is formed long in right-to-left direction over the indoor air intake portion 61 so that the filter can be inserted through the filter insertion slot 64.

A plurality of louvers 65 are rotatably provided under the upper tilted surface, and more particularly, within the indoor air blowing portion 62 to adjust a wind direction of the air blowing into the indoor space.

Besides, an outdoor air intake portion 55 is provided to at least one of right, left and upper sides of the outdoor frame 54 to suck the outdoor air.

In the present embodiment, outdoor air intake portions 58, 59 and 60 are provided to the left, right and upper sides of the outdoor frame 54, respectively. And, the air within the outdoor part is blown to the outdoor space via a backside of the outdoor frame 54.

Hence, the outdoor air is sucked via three faces of the outdoor frame 54 and is then blown in a rear direction via the backside of the outdoor frame 54.

An indoor blowing fan 76 and an indoor heat exchanger 124 are provided within the cabinet, and more particularly, within the indoor part I. And, an outdoor heat exchanger 136 and an outdoor blowing fan 138 are provided within the outdoor part O.

In this case, the indoor heat exchanger 124 is provided in the vicinity of one side of the indoor blowing fan 76, and preferably, between the indoor blowing fan 76 and a front side of the indoor frame 60 to exchange heat with the air that flows from the indoor air intake portion 61 to the indoor air blowing portion 62.

The outdoor blowing fan 138 is to suck an air into the outdoor part O and to blow the air to the outdoor space. And, the outdoor blowing fan 138 sucks the air in a circumferential direction to blow in a shaft direction, i.e., in a rear direction. Alternatively, the outdoor blowing fan 138 can include an axle fan that sucks air in a front direction to blow in a rear direction.

The outdoor heat exchanger 136 is provided in the vicinity of one side of the outdoor blowing fan 138, and preferably, in rear of the outdoor blowing fan 138 to exchange heat with the outdoor air that is sucked into the outdoor part O via the outdoor air intake portions 58.

Besides, an air guide 70 and 80 is provided within the cabinet 52, 54 and 60 to guide a flow of air.

In the present embodiment, the air guide 70 and 80 guides the air flowing within the indoor part I and communicates with the indoor air intake portion 61 and the indoor air blowing portion 62.

In particular, the air guide 70 and 80 guides the air, which is introduced into the cabinet via the indoor air intake portion 61, to the indoor air blowing portion 62.

In doing so, the air, which is introduced into the indoor part I via the indoor air intake portion 61, is introduced into the air guide via a front side of the air guide 70 and 80.

Preferably, the air guide 70 and 80 is configured to partition the cabinet into the indoor part I and the outdoor part O.

For this, the air guide 70 and 80 is provided onto the base panel 52.

In the present invention, since the air guide 70 and 80 guides the flow of air within the indoor part I, the indoor air blowing fan 76 is provided within the air guide 70 and 80.

Namely, in case that the air guide 70 and 80 is configured to guide the air flow within the outdoor part, the outdoor blowing fan 138 is provided within the air guide 70 and 80.

In this case, the indoor blowing fan 76 includes a centrifugal fan that sucks air in a shaft direction to blow in a circumferential direction, and more preferably, a constant-pressure centrifugal turbo fan.

A control box 92, which accommodates various components for controlling the combined type air conditioner according to the present invention, is provided to one side of the air guide 70 and 80.

Preferably, the indoor and outdoor blowing fans 76 and 138 are installed to be driven by one bi-shaft motor 128.

The bi-shaft motor 28 includes a front rotational shaft 128*a* projected in a front direction toward the front side of the indoor frame 60 to be connected to the indoor blowing fan 76 and a rear rotational shaft 128*b* projected toward the backside of the outdoor frame 54 to be connected to the outdoor blowing fan 138.

Hence, shaft directions of the indoor and outdoor blowing fans 76 and 138 connected to the front and rear rotational shafts 128*a* and 128*b* of the bi-shaft motor 128 correspond to front and rear directions, respectively.

Meanwhile, a shroud 126 is provided to the outdoor part O for form a path of the outdoor air moved by the outdoor bowing fan 138.

For this, the shroud 126 is fixed onto the base panel 52 by locking bolts and the like.

The shroud 126 includes an opening 127 so that the outdoor air sucked via the outdoor air intake ports 55 of the outdoor frame 54 can flow to an open backside portion 56 of the outdoor frame 54 via the opening 127.

A motor loading portion 130 is built in one body of a central portion of the shroud 126 so that the bi-shaft motor 128 can be loaded on the motor loading portion 130.

And, the outdoor blowing fan 138 is provided in rear of the opening 127 to be connected to the rear rotational shaft of the bi-shaft motor 128.

A plurality of locking portions 128*c* protrude from an outer circumference of the bi-shaft motor 128 to have a plurality of locking holes enabling the bi-shaft motor 128 to be fixed to the motor loading portion 130 by locking members such as screws and the like, respectively.

The motor loading portion 130 includes a motor fixing portion 131 having the motor 128 fixed thereto, a plurality of legs 132 between the shroud 126 and the motor fixing portion 131, and a support 133 supporting a lower part of the motor fixing portion 131.

A plurality of ribs 131*a* enclosing the outer circumference of the motor 128 are provided to an outer circumference of the motor fixing portion 131 to fix the bi-shaft motor 128 thereto.

And, the support 133 includes a flat plate portion 134 adhering closely to a backside of the air guide 70 and 80 to be supported.

The outdoor heat exchanger 136 is provided within or in rear of the shroud 82 to heat or cool down the air blown in a rear direction by the outdoor blowing fan 138.

A reference number '142' indicates a compressor mounted on the base panel 52 to be located within the outdoor part O.

A reference number '144' indicates a capillary tube provided between the outdoor heat exchanger 136 and the indoor heat exchanger 124 to expand the condensed refrigerant.

Figure 7:
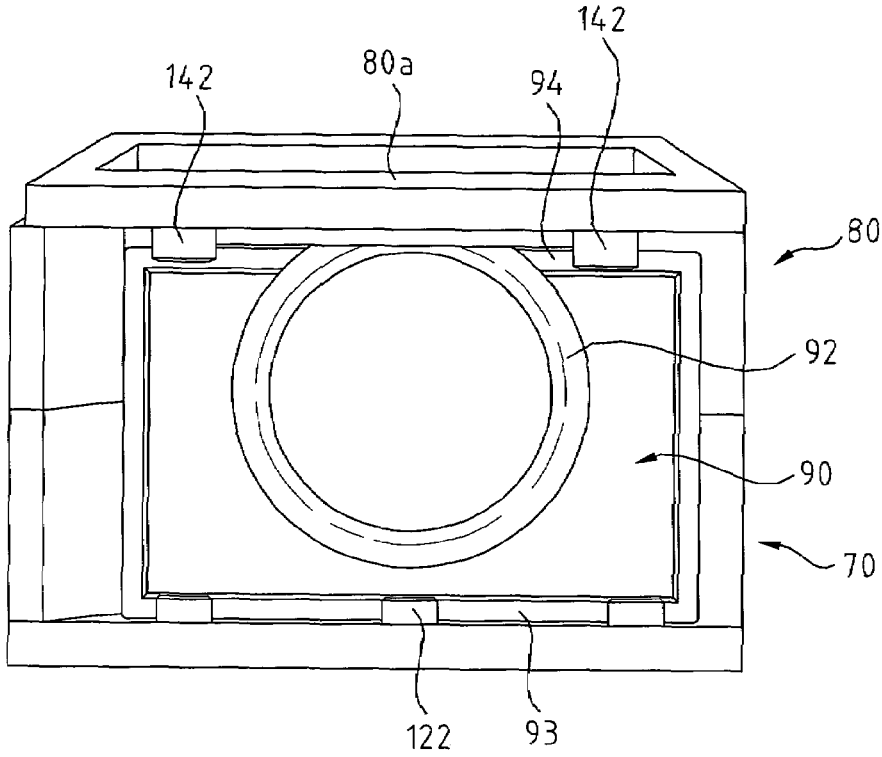
FIG. 7 is a front diagram of an air guide shown in FIG. 4.

The air guide 70 and 80 of the combined type air conditioner according to the present invention is explained in detail with reference to FIGS. 5 to 7 as follows.

The air guide 70 and 80 includes a lower guide 70 provided to the base panel 52 forming the bottom of the cabinet and an upper guide 80 joined to an upper part of the lower guide 70.

The lower and upper guides 70 and 0 configure a fan accommodating portion 71 ad 81 accommodating the indoor blowing fan 76. And, the upper guide 80 covers an upper side of the indoor blowing fan 76.

In particular, the lower guide 70 accommodates a lower part of the indoor blowing fan 76 and the upper guide 80 accommodates an upper part of the indoor blowing fan 76.

For this, the lower guide 72 includes a lower fan accommodating portion 71. And, the lower fan accommodating portion 71 includes a left side portion 71*a*, a right side portion 71*b*, a backside portion 71*c* and a bottom 71*d*.

And, the upper guide 80 includes a blowing guide 82 guiding the air air-conditioned by the indoor heat exchanger to the indoor air blowing portion 62.

In particular, an opening is provided to a font side of the air guide 70 and 80.

For this, openings are provided to front and upper sides of the lower housing 70, respectively and another opening is provided to a bottom of the upper guide 80.

The lower guide 70 includes a base portion (not shown in the drawing) having a drain pan 72 to catch the condensed water generated from the indoor heat exchanger.

The base portion includes a bottom 71*d* of the lower fan accommodating portion and the drain pan 72.

In this case, the drain pan 72 is provided to a front bottom of the lower fan accommodating portion 71 to form a front part of the base portion. And, the indoor heat exchanger 124 is provided over the drain pan 72.

The upper guide 75 includes an upper fan accommodating portion 81 built in one body of the blowing guide 82. The upper fan accommodating portion 81 includes a left side portion 81*a*, a right side portion 81*b* and a rear side portion 81*c*. And, openings are provided to front and bottom sides of the upper fan accommodating portion 81, respectively.

A lower end of the upper fan accommodating portion 81 configures a lower end of the upper guide 80 and an upper end of the lower fan accommodating portion 71 configures an upper end of the lower guide 70. Hence, an indoor fan accommodating portion is provided to the air guide 70 and 80 and the opening is provided to the front side of the air guide 70 and 80.

Meanwhile, the blowing guide 82 includes a left side portion 82*a*, a right side portion 82*b*, a backside portion 82*c*, a topside portion 82*d* and a partition rib 80*a*.

The partition rib 80*a* partitions a space into the upper fan accommodating portion 73 and an exit of the blowing guide 82. For this, the partition rib 80*a* is formed long in right-to left direction and has a prescribed width in front-to-rear direction to guide the air to the indoor air blowing portion 62.

Besides, the air guide further includes an orifice 90 provided in front of the indoor blowing fan 76 to cover the opening provided to the front side of the air guide.

The orifice 90 is provided in rear of the indoor heat exchanger 124 to accelerate a speed of the air introduced into the indoor blowing fan 76. And, the orifice 90 includes a body portion 91 and a passage portion 92 provided to a central part of the body portion 91 to be perforated in a shaft direction of the indoor blowing fan 76.

In this case, a lower edge 93 of the orifice 90 is held by the lower guide 70 and an upper edge of the orifice 90 is held by the upper guide 80.

For this, the lower guide 70 includes at least one lower end holding portion 120 into which a lower end, i.e., the lower edge 93 of the orifice 90 is fitted.

And, the upper guide 80 includes at least one upper end holding portion 140 into which an upper end, i.e., the upper edge 94 of the orifice 90 is fitted.

In the present embodiment, the lower end holding portion 120 is provided to the base portion of the lower guide 70 in rear of the drain pan 72 and the upper end holding portion 140 is provided to the partition rib 80*a* forming the bottom side of the blowing guide 82.

In order that the upper and lower ends of the orifice are held by the upper and lower end holding portions 140 and 120, respectively, the upper edge 94 of the orifice 90 includes an upper flange extending in a front direction and an upper rib bent upward from a front end of the upper flange and the lower edge 93 of the orifice 90 includes a lower flange extending in a front direction and a lower rib bent downward from a front end of the lower flange.

Optionally, a left side edge (not shown in the drawing) of the orifice 90 includes a left side flange extending in a front direction and a left side rib bent from a front end of the left side flange in a left direction. And, a right side edge (not shown in the drawing) of the orifice 90 includes a right side flange extending in a front direction and a right side rib bent from a front end of the right side flange in a right direction.

And, an upper end of the passage portion 92 is projected higher than the upper edge 94 of the orifice 90.

Figure 8:
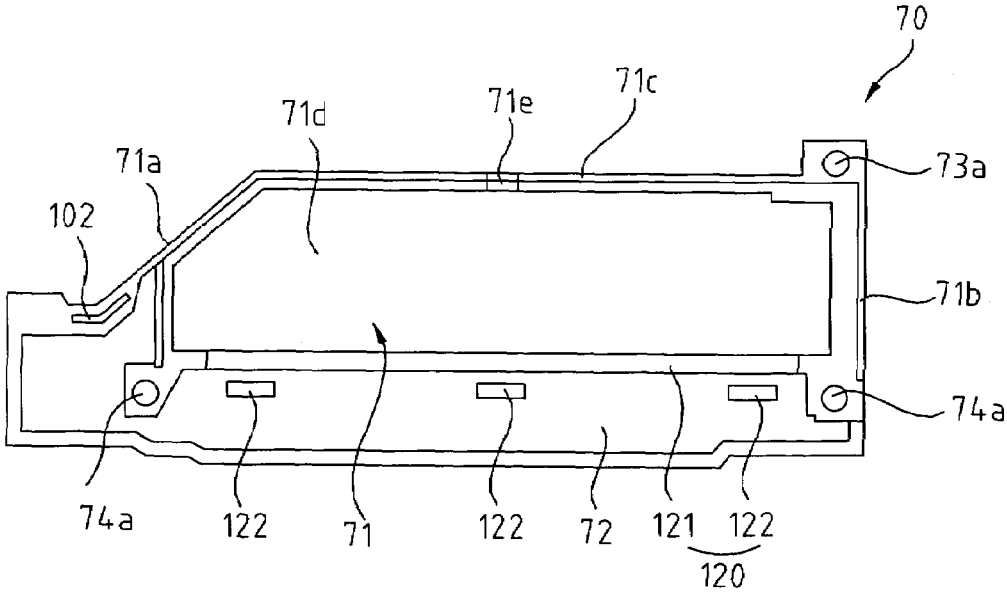
FIG. 8 is a layout of a lower guide shown in FIG. 4.
Figure 9:
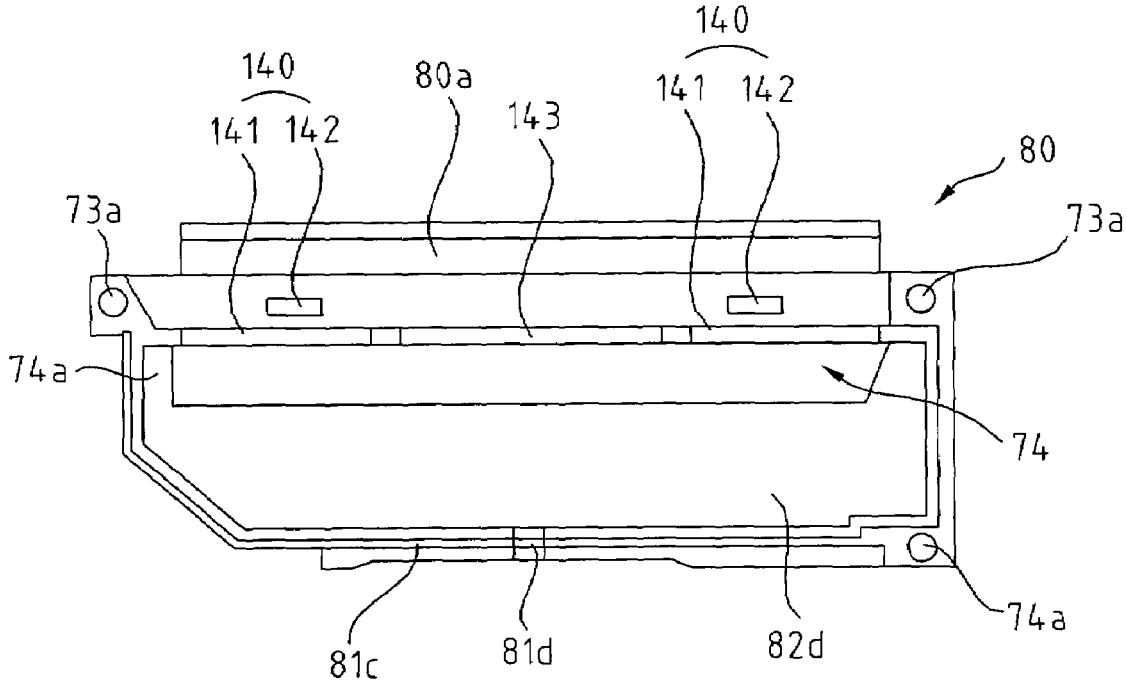
FIG. 9 is a bottom diagram of an upper guide shown in FIG. 4.

The lower guide 70 and the upper guide 90 are explained in detail with reference to FIG. 8 and FIG. 9 as follows.

First of all, the lower end holding portion 120 includes at least one lower support wall 121 protruding upward from the base portion of the lower guide 70 and at least one lower support protrusion 122.

The at least one lower support wall 121 supports a rear side of the lower edge 93 of the orifice 90 and the at least one lower support protrusion 122 is spaced apart from the lower support wall 121 in a front direction with a prescribed gap to support a front side of the lower edge 93 of the orifice 90.

In the present embodiment, one lower support wall 121 extending ling in right-to-left direction and a plurality of lower support protrusions 122 spaced apart from each other with a prescribed distance in-between are provided to the base portion of the lower guide 70.

And, the lower rib of the orifice is fitted into the gap between the lower support wall 121 and the lower support protrusion 122 to be held.

The upper end holding portion 140 includes at least one upper support wall 141 protruding downward from the partition rib 80*a* forming the bottom of the blowing guide 82 and at least one upper support protrusion 142.

In this case, the at least one upper support wall 141 supports a rear side of the upper edge 94 of the orifice and the at least one upper support protrusion 142 is spaced apart from the upper support wall 141 in a front direction to leave a prescribed gap in-between to support a front side of the upper edge 94 of the orifice.

Hence, the upper rib of the orifice is fitted in the gap between the upper support wall 141 and the upper support protrusion 142 to be held.

Preferably, the upper holding portion 140 further includes a holding recess 143 provided to the upper guide 80 so that an upper end 92*a* of the passage portion 92 is fitted in the holding recess 143 to be hung therein.

Meanwhile, a lower shaft hole 71*e* is provided to a backside 71*c* of the lower fan accommodating portion to be penetrated by the front rotational shaft 128*a*. And, an upper shaft hole 81*d* is provided to a backside 81*c* of the upper fan accommodating portion to be penetrated by the front rotational shaft 128*a*.

And, at least one assembly protrusion 73*a* and at least one assembly recess 74*a* are provided to the upper ends of the lower and upper guides 70 and 80 for the assembly between the lower and upper guides 70 and 80.

A Process of assembling the orifice 90 to the above-configured lower and upper guides 70 and 80 is explained as follows.

First of all, the lower rib provided to the lower edge 93 of the orifice is inserted between the lower support wall 121 and the lower support protrusion 122 of the lower guide 70. The lower flange of the orifice 90 is then pushed to adhere closely to the upper end of the lower support wall. Hence, the lower edge 93 of the orifice is fixed to the lower guide 70.

Subsequently, the upper guide 80 is placed over the lower guide 70 to insert the assembly protrusion 73*a* in the assembly recess 74*a*. Hence, the upper guide 80 is assembled to the upper part of the lower guide 70.

In doing so, since the upper rib of the orifice is inserted between the upper support wall 141 and the upper support protrusion 142 to be hung, the orifice 90 can be securely fixed to the lower and upper guides 70 and 80.

Alternatively, after the orifice and the upper guide have been assembled together, the lower guide can be assembled to the upper guide.

Namely, while the orifice 90 is fitted in either the upper or lower guide 80 or 70 to be hung, either the lower or upper guide 70 or 80 is assembled to either the upper or lower guide 80 or 70 to which the orifice 90 is assembled. Thus, the orifice 90 is fixed to the air guide.

Figure 10:
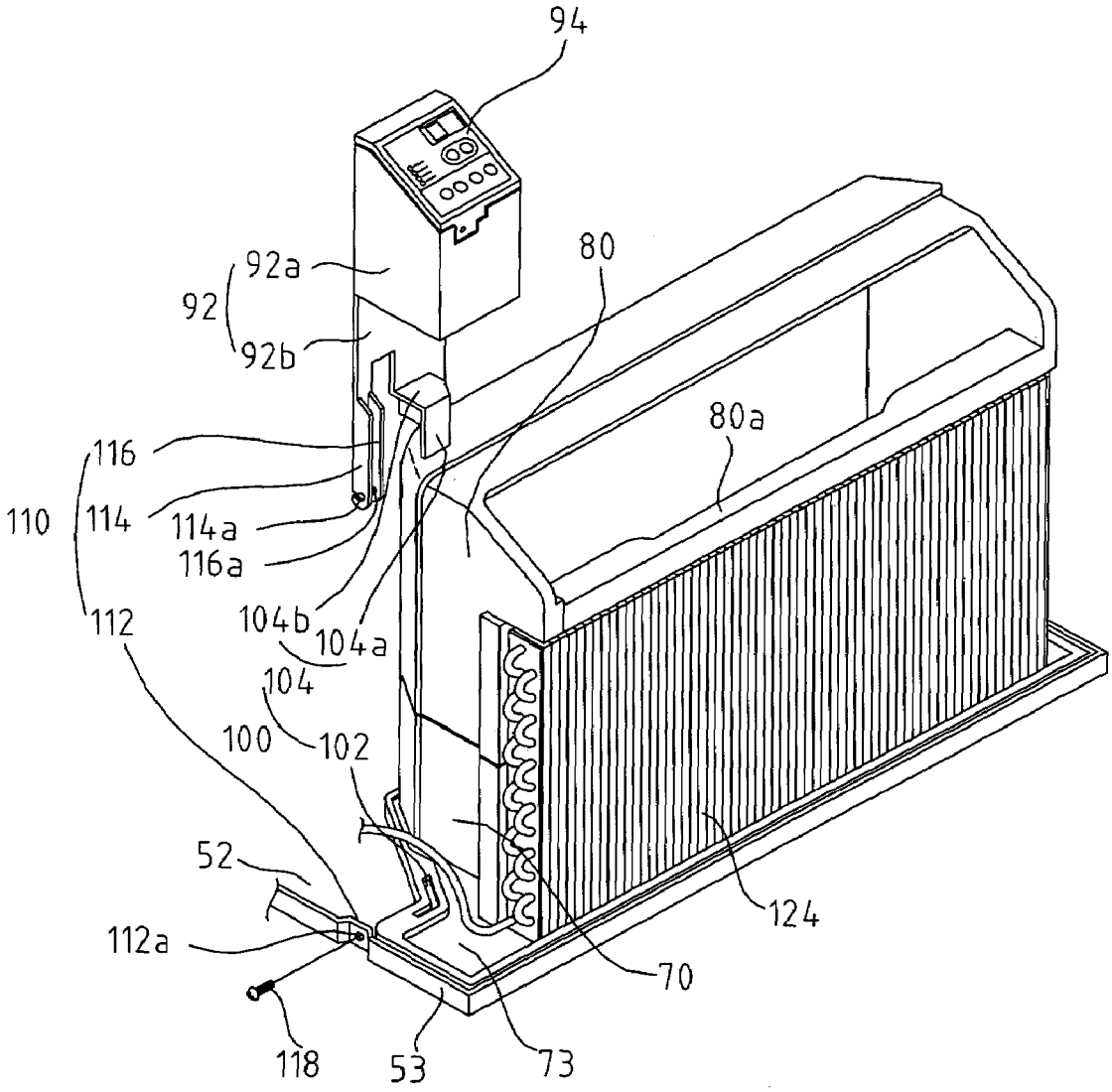
FIG. 10 is an exploded perspective diagram of a control box and an air guide shown in FIG. 4.
Figure 11:
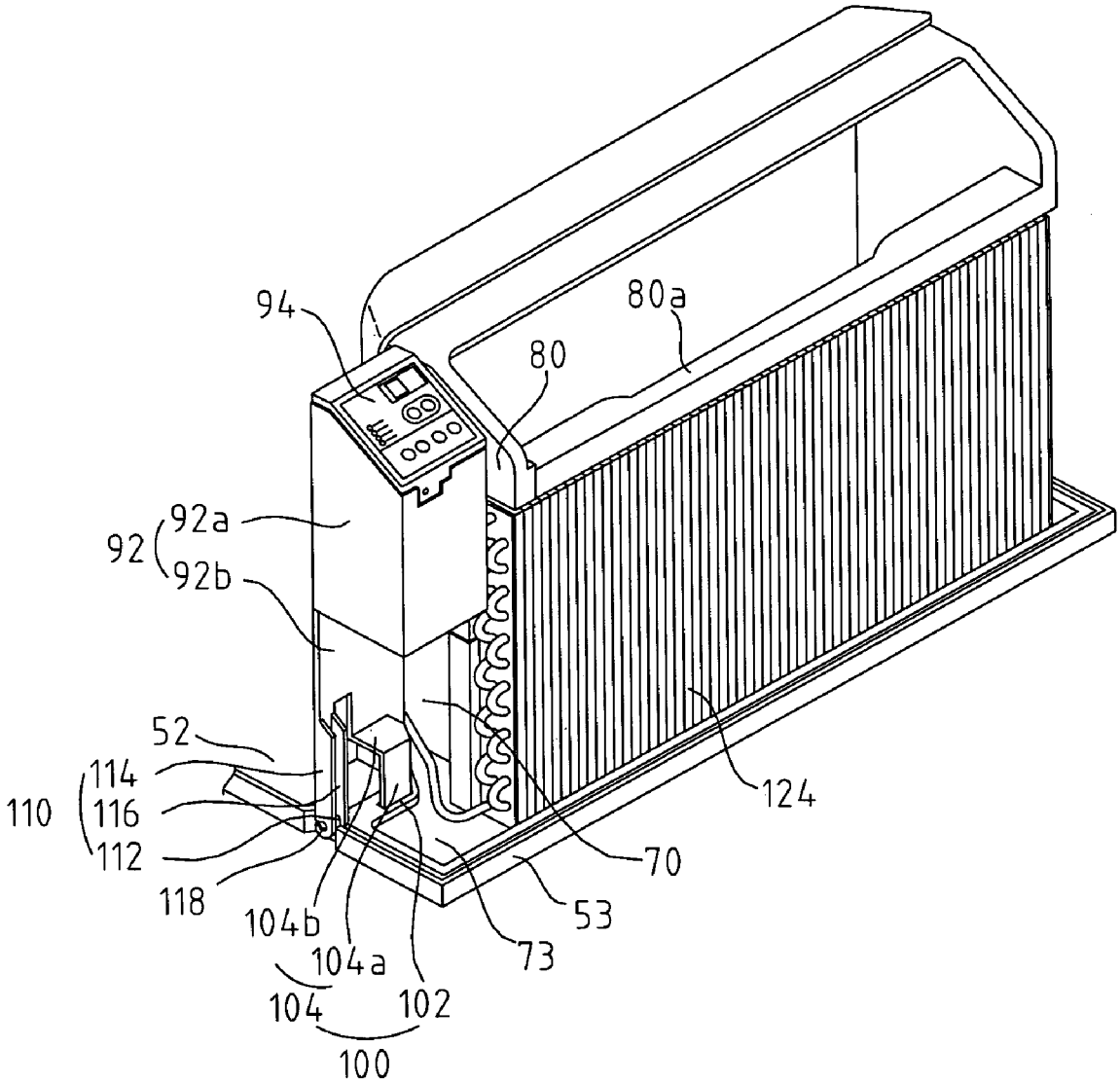
FIG. 11 is a perspective diagram of a control box assembled to one side of an air guide shown in FIG. 4.

The control box 92, which accommodates various electric/electronic components to control the combined type air conditioner and partitions the cabinet into the indoor part I and the outdoor part O, is explained with reference to FIG. 5, FIG. 10 and FIG. 11 as follows.

First of all, the control box 94 includes a box portion 92*a* and a partition body 92*b* joined to the box portion 92*a*.

The box portion 92*a* is provided to an upper front part of the partition body 92*b*. A control panel 94, which is exposed to one upper side of the indoor frame 60 to display operational information of the air conditioner, is installed at the box portion 92*a*. In this case, the control panel 94 is provided with various operational buttons.

A control board 96 is loaded in the box portion 92*a*. In this case, an electric/electronic component 95, which outputs control signals for controlling the compressor 142 and the bi-shaft motor 128, respectively and an operational information signal to the control panel 94, is mounted on the control board 96.

The partition body 92*b* is provided to one side of the air guide 70 and 80 to partition the cabinet into the indoor part I and the outdoor part O together with the air guide.

In this case, the partition body 92*b* is vertically arranged long to a lateral side of the air guide and is built in one body of the box portion 92*a*.

The control box 92 is connected to the lower guide 70 by a support portion 100, which will be explained later, to be supported thereon and is assembled to the base panel 52 forming the bottom of the cabinet by a fixing unit 110, which will be explained later, to be fixed thereto.

The support portion 100 includes a support recess portion 102 provided to the base portion of the lower guide 70 and a support member 104 inserted in the support recess portion 102.

Hence, in assembling the control box 92 to one side of the air guide, the support portion 100 aligns a position of the control box 92 and supports the control box 92 not to be shaken, simultaneously.

The support member 104 has a horizontal cross-section having the same shape of the support recess portion 102. And, to correspond to a position of the support recess portion 102, the support member 104 includes a horizontal portion 104*a* projected from one side of the partition body 92*b* of the control box 92 in a front direction and a vertical portion 104*b* bent downward from a front end of the horizontal portion 104*a* to be fitted in the support recess portion 102.

The fixing unit 110 includes a fixing member 114 and 116 provided to the partition body 92*b* and a locking rib 112 provided to the base panel 52 configuring the bottom of the cabinet.

The fixing member 114 and 116 is joined to the locking rib 112. And, the fixing member 114 and 116 includes a pair of insertion ribs 114 and 116 spaced in parallel apart from each other with a prescribed gap so that the locking rib 112 can be inserted between a pair of the insertion ribs 114 and 116.

And, the locking rib 112 is formed by bending an edge 53 of the base panel 52 in part.

Moreover, a plurality of locking holes 112*a*, 114*a* and 116*a* are provided to the locking rib 112 and the insertion ribs 114 and 116, respectively to be locked by a bolt 118.

The gap between the insertion ribs 114 and 116 are formed equal to or greater than a thickness of the locking rib 112.

And, the fixing means (fixing unit) 110 further includes a locking member (bolt) 118 locking the bent portion (locking rib) 112 and the insertion ribs 114 and 116.

Preferably, a length of the locking rib 112 is set almost equal to a width of each of the insertion ribs 114 and 116 to prevent the completely assembled control box from being shaken.

Accordingly, the present invention provides the following effects or advantages.

First of all, in the combined type air conditioner according to the present invention, since the air guide provided within the cabinet includes the lower guide and the upper guide joined to the upper part of the lower guide to be built in one body of the blowing guide, the air guide has the simple configuration and facilitates its fabrication.

Secondly, in the combined type air conditioner according to the present invention, the assembly between the orifice and the air guide is facilitated.

Thirdly, in the combined type air conditioner according to the present invention, the holding recess supporting the upper end of the passage portion of the orifice is provided to the upper guide to fix the orifice to the air guide securely.

Fourthly, in the combined type air conditioner according to the present invention, since the control box provided to one side of the air guide partitions the interior of the cabinet together with the air guide, the air guide has the simple configuration and facilitates its fabrication.

Fifthly, in the combined type air conditioner according to the present invention, since the installation configuration of the control box is simplified, the control box can be easily assembled to one side of the air guide and can be securely fixed thereto.

Sixthly, in the combined type air conditioner according to the present invention, since the support member of the control box is inserted in the support recess provided to the bottom of the air guide, the alignment of the control box is facilitated to further simplify the assembly work of the control box.

Finally, in the combined type air conditioner according to the present invention, since the fixing member of the control box is joined to the locking rib formed by bending the edge of the base panel in part, it is able to prevent the control box from being shaken or being separated by the vibration appearing in operating the air conditioner. And, the separation or short-circuit of the electric/electronic components is prevented. Moreover, robustness of the locking rib is enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A combined type air conditioner comprising:

a cabinet forming an exterior of the air conditioner to suck and blow an air by driving a blowing fan;

an air guide guiding the air introduced into the cabinet to an air blowing port provided to the cabinet; and a control box provided within the cabinet to accommodate various components for controlling the combined type air conditioner, the control box partitioning the cabinet into an indoor pail and an outdoor part together with the air guide.

2. The combined type air conditioner of claim 1, the control box comprising:

a partition body provided to one side of the air guide to partition the cabinet together with the air guide; and a box portion provided to an tipper front part of the partition body wherein a control panel displaying operational information is installed at the box portion.

3. The combined type air conditioner of claim 1, the control box comprising:

a support member connected to the lower guide to be supported; and a fixing member joined to a bottom of the cabinet to be fixed thereto.

4. The combined type air conditioner of claim 3, wherein a lower end of the support member is inserted in a support recess portion provided to a base portion configuring a bottom of the lower guide.

5. The combined type air conditioner of claim 4, wherein the support member is provided to a partition body configuring a backside of the control box and wherein the partition body partitions the cabinet together with the air guide.

6. The combined type air conditioner of claim 4, wherein the fixing member is provided to a partition body configuring a backside of the control box and wherein the partition body partitions the cabinet together with the air guide.

7. The combined type air conditioner of claim 6, wherein the fixing member comprises a pair of insertion ribs spaced apart from each other in parallel to leave a gap in-between and wherein a locking rib provided to the bottom of the cabinet is inserted between a pair of the insertion ribs to be fixed thereto.

8. The combined type air conditioner of claim 7, wherein a locking hole is provided to each of the locking rib and the insertion ribs to be locked by a locking member.

9. The combined type air conditioner of claim 7, wherein the locking rib is formed by bending an edge of a base panel configuring the bottom of the cabinet in part.

10. The combined type air conditioner of claim 2, further comprising a lower guide and an upper guide, wherein the lower guide comprises a fan accommodating portion accommodating an indoor blowing fan and a drain pan catching condensed water generated from a heat exchanger, and the upper guide located at the upper part of the lower guide comprises a fan accommodating portion accommodating the indoor blowing fan and a blowing guide guiding the air blown by a indoor heat exchanger to the indoor air blowing portion.

11. The combined type air conditioner of claim 10, wherein the lower fan accommodating portion includes a left side portion, a right side portion, a backside portion and a bottom.

12. The combined type air conditioner of claim 10, wherein the upper guide comprises a partition rib partitioning a space into the upper fan accommodating portion and an exit of the blowing guide.

13. The combined type air conditioner of claim 10, wherein the indoor air blowing portion comprises a left side portion, a right side portion, a backside portion, a top side portion and a partition rib.

14. The combined type air conditioner of claim 10, wherein the upper fan accommodating portion includes a left side portion, a right side portion and a backside portion.

* * * * *